United States Patent [19]

Mossberg

[11] Patent Number: 4,841,657

[45] Date of Patent: Jun. 27, 1989

[54] SMOOTH BORE FIREARM HAVING AXIALLY ROTATABLE BARREL

[75] Inventor: Alan I. Mossberg, Hamden, Conn.

[73] Assignee: O. F. Mossberg & Sons, Inc., North Haven, Conn.

[21] Appl. No.: 191,697

[22] Filed: May 9, 1988

[51] Int. Cl.[4] ..... F41C 21/00

[52] U.S. Cl. ..... 42/76.01; 89/14.05

[58] Field of Search ..... 42/76.01, 77, 78; 89/14.05, 16

[56] References Cited

U.S. PATENT DOCUMENTS 2,406,089 8/1946 Martineau ..... 42/76.01
3,805,434 4/1974 Sudano ..... 42/77

FOREIGN PATENT DOCUMENTS 2518976 11/1976 Fed. Rep. of Germany ..... 42/77
3509174 9/1986 Fed. Rep. of Germany ..... 42/77

*Primary Examiner*—Deborah L. Kyle
*Assistant Examiner*—Richard W. Wendtland
*Attorney, Agent, or Firm*—McCormick, Paulding & Huber

[57] ABSTRACT

A firearm having a movable barrel including an axially elongated smooth bore. The barrel moves in an axial direction and simultaneously rotates about its axis when a round of slug ammunition is discharged by the firearm whereby to impart rotary motion to the slug as it travels through the bore so that the slug is rotating about its axis of trajectory as it leaves the muzzle of the firearm and travels toward a target.

18 Claims, 1 Drawing Sheet

SMOOTH BORE FIREARM HAVING AXIALLY ROTATABLE BARREL

BACKGROUND OF THE INVENTION

This invention relates in general to firearms and deals more particularly with improvements in firearms of the smooth bore type.

A smooth bore firearm, such as a shotgun, used in hunting fast-breaking small game is not ideally suited to fire a solid projectile or slug of the type required in hunting deer or other large game. However, interchangeable barrels have been provided to adapt a firearm of the aforedescribed type to all types of hunting and shooting. It is also known in the art to provide a gun having a rotary barrel without rifling in its bore and which will impart spinning motion to a bullet. Such a gun is disclosed in U.S. Pat. No. 2,406,089 to Martineau, issued Aug. 20, 1946. In the Martineau firearm, barrel rotation is accomplished by means of a turbine rotor attached to the barrel and driven by gas liberated on explosion of a cartridge.

The general aim of the present invention to further increase the versatility of a basic firearm, such as a shotgun, by providing an improved smooth bore rotary barrel mechanism for firing both shotgun shells and slug type ammunition.

SUMMARY OF THE INVENTION

The firearm of the present invention has a receiver, a barrel assembly mounted on the receiver and which includes an axially elongated barrel having a smooth bore extending coaxially through it, means defining a chamber communicating with the rear end of the bore for receiving a round of ammunition, and firing means associated with the receiver for discharging a round of ammunition contained within the chamber. In accordance with the invention the firearm is provided with means for supporting the barrel to axially reciprocate and rotate about its axis relative to the receiver, means for moving said barrel in an axially forward direction in response to the gases of explosion produced by the discharge of a round of ammunition within the chamber, and means for imparting rotational movement to the barrel in response to the axial movement of the barrel relative to the receiver.

DETAILED DESCRIPTION OF PREFERRED EMBODIMENT

Figure 1:
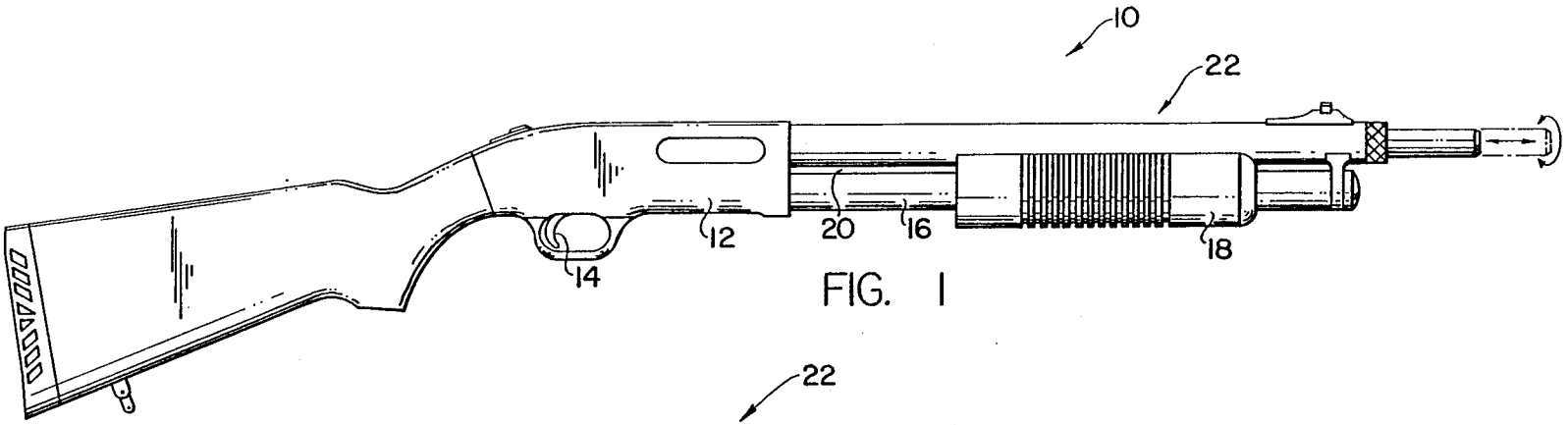
FIG. 1 is a side elevational view of a typical shotgun embodying the present invention.

Turning now to the drawing, a typical firearm embodying the present invention is indicated generally by the reference numeral 10. The illustrated firearm 10 is a modified Model 500 pump action shotgun manufactured and marketed by O. F. Mossberg & Sons, Inc., 7 Grasso Avenue, North Haven, Conn. 06473, assignee of the present invention, and has a receiver 12 containing a conventional firing mechanism (not shown) operated by an associated trigger 14 for discharging the firearm. The shotgun 10 further includes a magazine tube 16 connected to the receiver for containing a plurality of rounds of ammunition and a manually operable reciprocally movable forearm 18 for moving an action slide assembly 20 to operate the firearm action in a manner well known in the art. The elements of the firearm 10 hereinbefore discussed comprise conventional parts of a MOSSBERG 500 pump action shotgun and will not be hereinafter discussed in detail.

In accordance with the present invention, the illustrated firearm 10 has a modified barrel assembly designated generally by the numeral 22 and adapted to fire either conventional shotgun shells used in hunting small fast-breaking game, or slug type ammunition used in hunting large game, such as deer.

Figure 2:
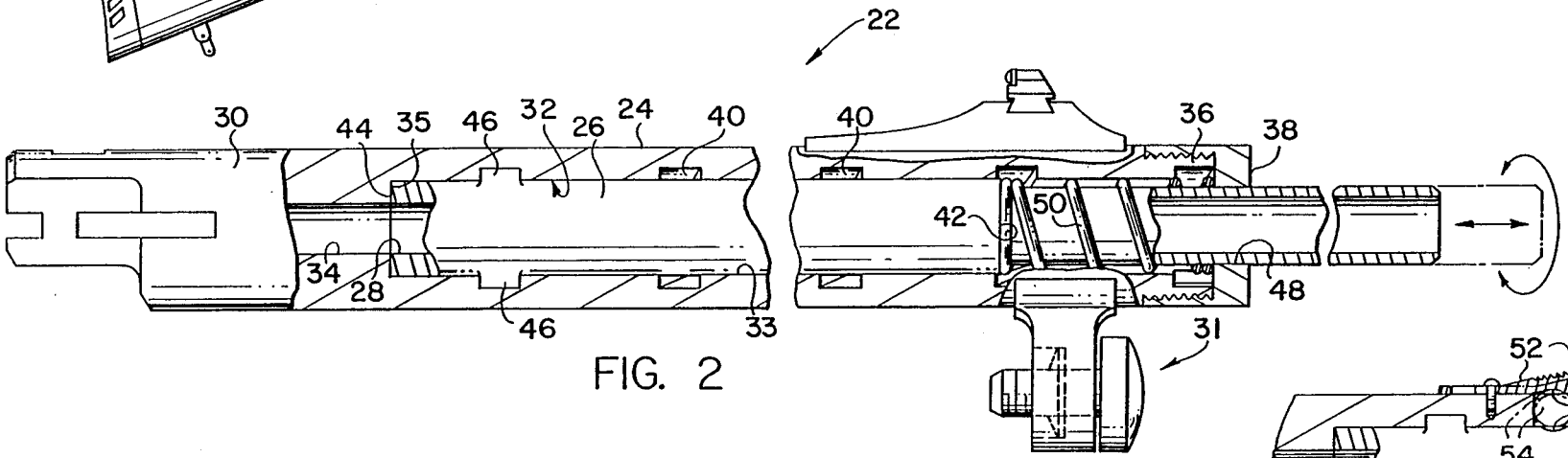
FIG. 2 is a somewhat enlarged fragmentary side elevational view of the shotgun barrel assembly shown partially in axial section.

Referring now particularly to FIG. 2, the barrel assembly 22 essentially comprises an outer member or barrel sleeve 24 which supports a movable inner member or barrel 26 having a smooth bore 28 extending coaxially through it. The illustrated barrel sleeve 24 is generally cylindrical and particularly adapted for releasable connection to the receiver 12 of the illustrated modified Model 500 shotgun and for this reason it has a locking portion 30 at its breech end which includes locking recesses for engaging associated locking lugs (not shown) contained within the forward end of the receiver 12. However, it should be understood that other arrangements for connecting the barrel sleeve to an associated receiver may be provided and are contemplated within the scope of the present invention. Thus, for example, the barrel sleeve 24 may be threadably connected to the receiver of an associated firearm or, if desired, secured in permanent fixed relation to the receiver by a brazing operation or the like.

A conventional take-down mount and screw assembly, indicated generally at 31, is attached to and depends from the lower surface of the barrel sleeve 24 for further securing the barrel in assembly with the receiver 12, in a manner well known in the art. A front sight is preferably mounted o the barrel sleeve near its forward end.

Figure 3:
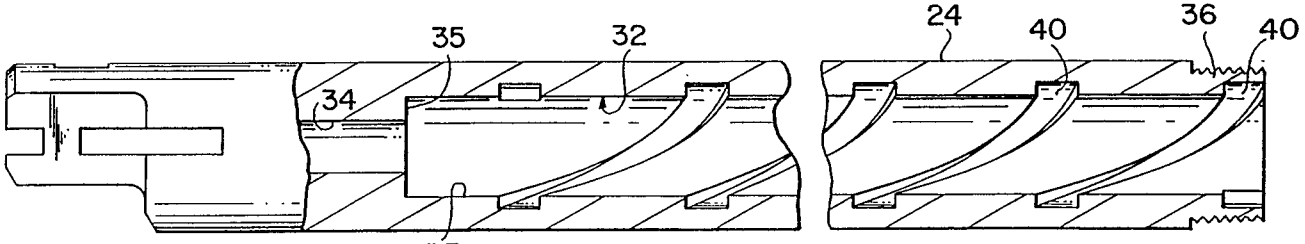
FIG. 3 is a side elevational view of the barrel sleeve shown partially in axial section with the barrel removed therefrom.

A stepped bore, indicated generally at 32, extends coaxially through the barrel sleeve 24 and includes a cylindrical main portion 33 and a reduced diameter portion at the rear or breech end of the sleeve which defines a chamber 34 for receiving a round of ammunition (not shown). A generally radially disposed forwardly facing annular abutment surface 35 is formed on the barrel sleeve between the main portion 33 and the chamber 34. The barrel sleeve has reduced diameter portion 36 at its forward end which is externally threaded to receive a generally cylindrical nut 38, substantially as shown. At least one helical groove 40 formed in the barrel sleeve 24 opens inwardly into the bore main portion 33 and through the forward end of the barrel sleeve, as best shown in FIG. 3. However, the illustrated embodiment of the invention has two such grooves which terminate at diametrically opposite locations near the front and rear ends of the main bore portion 33, as best shown in FIG. 3. The pitch of the helical grooves 40,40 may vary and will depend, at least to some degree, upon the axial length of the barrel sleeve 24, but preferably, a pitch is chosen which will assure smooth operation of the movable barrel 26, as will be hereinafter further discussed.

The movable barrel 26 is generally cylindrical and has a front end portion of reduced diameter and a generally radially disposed and forwardly facing annular shoulder 42 at the junction between the front end portion and the main portion of the barrel. The smooth walled cylindrical bore 28 is substantially uniform throughout its length and has a diameter substantially equal to the diameter of the chamber 34. A rearwardly facing annular shoulder 44 at the rear or breech end of the barrel is adapted for engagement with the forwardly facing annular abutment surface 35 on the barrel sleeve. At least one cylindrical lug 46 projects radially outward from the breech end of the barrel 26. However, the illustrated shotgun 10 has two such lugs 46,46 which project outwardly from diametrically opposite sides of the barrel. Each lug 46 is received within an associated one of the helical grooves 40,40. The barrel 26 is positioned within the bore 32 with the lugs 46,46 located proximate the inner terminal ends of the grooves 40,40 and the annular shoulder 44 disposed in generally abutting engagement with the annular abutment surface 35.

The nut 38 is threadably engaged with the forward end of the barrel sleeve 24 and includes a cylindrical opening 48 having a diameter substantially equal to the outside diameter of the forward end portion of the barrel which extends through the opening in the nut. A barrel return spring 50 coaxially surrounds an associated front portion of the barrel 26 and acts between the nut 38 and the shoulder 42 to urge the barrel in a rearward direction and to the position hereinbefore described wherein the rearwardly facing annular shoulder 44 is disposed in generally abutting engagement with the annular abutment surface 35. It will now be apparent that the barrel 26 is supported by the barrel sleeve 24 for simultaneous forward axial movement and rotational movement about its axis within and relative to the barrel sleeve 24 against the biasing force of the barrel return spring 50.

Preparatory to firing a round of slug ammunition, the trigger mechanism is set in its cocked position and the barrel 26 is biased to its rearward position by the barrel return spring 50. In the latter position of the barrel 26 the annular shoulder 44 is disposed generally adjacent the annular abutment surface 35. When a round of slug ammunition is fired by drawing back on the trigger 14, the expanding gases of its explosion within the bore 28 propel the slug toward the muzzle end of the barrel 26. The initial frictional force between the slug and the bore wall 28 causes the barrel to move in a forward direction against the rearwardly directed force exerted by the barrel return spring 50. Thereafter, the expanding gases of explosion within the bore 28 and behind the slug (not shown) act upon the annular surface 44 to urge the barrel 26 in a forward direction against the biasing force of the barrel return spring 50. The lugs 46,46 cooperate with the helical grooves 40,40 to impart rotational motion to the barrel as the barrel moves in an axial forward direction within and relative to the barrel sleeve 24. This rotary motion of the barrel imparts a corresponding rotary motion to the slug as it travels through the barrel so that the slug is rotating about its axis of trajectory as it leaves the muzzle of the firearm 10. The spinning motion imparted to the slug increases its stability and helps it to maintain a true path to a target.

When the slug clears the muzzle of the firearm the gases of explosion escape from the muzzle end of the bore 28 allowing the barrel to return to its initial position in response to the biasing force exerted on the barrel by the barrel return spring 50.

Figure 4:
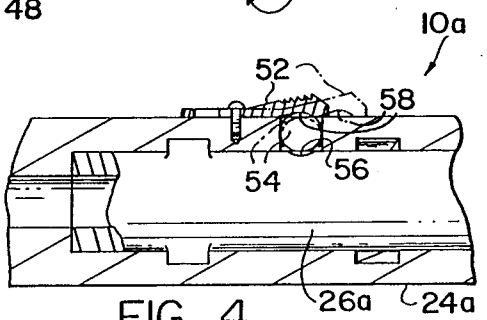
FIG. 4 is a fragmentary, sectional view showing another embodiment of the present invention.

When the gun of the present invention is used to fire a shot or pellet load it may be desirable to restrain the barrel against movement relative to the barrel sleeve and for this purpose a barrel locking device may be provided to selectively releasably secure the barrel against movement relative to the barrel sleeve. The barrel locking device may take various forms and in FIG. 4 there is shown another embodiment of the invention indicated generally at **10*a*, which includes such a device for selectively locking the barrel 26*a* against movement relative to the barrel sleeve 24*a*. The illustrated locking device, indicated generally at 51, essentially comprises a locking slide 52 supported for reciprocal sliding movement on the barrel sleeve 24*a* between barrel releasing and locking position indicated, respectively, in full and broken lines. In its locking or broken line position of FIG. 4, the locking slide 52 urges a locking ball 54 into and holds the ball within a parti-spherical locking recess 56 formed in the barrel 26*a* so that the ball 54 is maintained across a line-of-shear between the barrel and the sleeve to prevent movement of the barrel relative to the sleeve. When the slide 52 is moved to its barrel releasing position, a parti-spherical pocket 58 in the slide 52 is aligned with the locking ball 54 and receives the ball when force is applied to the barrel 26*a* in an axial direction to move the barrel axially and rotate it about its axis relative to the barrel sleeve 24*a***.

I claim:

1. In a firearm having a receiver, an axially elongated barrel assembly supported on and projecting in an axially forward direction from the receiver and defining a coaxial bore extending therethrough, means defining a chamber for communicating with the rear end of the bore, and a firing mechanism supported by the receiver for discharging a round of ammunition contained within the chamber, the improvement comprising said barrel assembly including a barrel member defining said bore, means supporting said barrel member for axial and rotational movement relative to the receiver, means for moving the barrel member in an axially forward direction relative to the receiver in response to pressure exerted by gases of explosion generated by the discharge of a round of ammunition within said chamber, and means for rotating said barrel member about its axis in response to axial movement of said barrel member relative to said receiver.

2. In a firearm as set forth in claim 1 the further improvement comprising means for biasing said barrel member in a rearward direction and toward said receiver.

3. In a firearm as set forth in claim 2 the further improvement wherein said biasing means comprises a spring.

4. In a firearm as set forth in claim 1 the further improvement wherein said supporting means comprises a barrel sleeve member mounted in fixed position on said receiver and receiving said barrel member therein.

5. In a firearm as set forth in claim 4 the further improvement comprising means for retaining said barrel member within said barrel sleeve member for limited axial movement therein and relative thereto.

6. In a firearm as set forth in claim 5 the further improvement wherein said retaining means comprises a nut threadably engaged with said barrel sleeve member and receiving a portion of said barrel member therethrough.

7. In a firearm as set forth in claim 6 the further improvement comprising biasing means for urging said barrel member in a rearward direction within said barrel sleeve member.

8. In a firearm as set forth in claim 7 the further improvement wherein said biasing means comprises a spring coaxially surrounding an associated portion of said barrel member and acting between said nut and said barrel member.

9. The combination as set forth in claim 4 wherein said barrel sleeve member defines said chamber.

10. In a firearm as set forth in claim 4 the further improvement wherein said barrel sleeve member includes a bore coaxially receiving said barrel therein and said rotating means comprises at least one helical groove formed in one of said members comprising said barrel member and said barrel sleeve member and a radially extending lug on the other of said members received within said helical groove.

11. In a firearm as set forth in claim 10 the further improvement wherein said one member comprises said barrel sleeve member and said other member comprises said barrel member.

12. In a firearm as set forth in claim 10 the further improvement wherein said one member has a pair of helical grooves formed therein and said other member has a pair of diametrically opposed lugs thereon, each of said lugs being engaged within an associated one of said helical grooves.

13. In a firearm as set forth in claim 4 the further improvement wherein said means for axially moving said barrel member comprises a rearwardly facing annular shoulder on said barrel member.

14. In a firearm as set forth in claim 13 the further improvement wherein said means for axially moving said barrel further comprises a forwardly facing annular abutment surface on said barrel sleeve member.

15. In a firearm having a receiver, a barrel assembly mounted on the receiver and defining an axially forwardly extending bore, means defining a chamber for communicating with the rear end of the bore and receiving a round of ammunition therein, and firing means associated with the receiver for discharging a round of ammunition contained within the chamber, the improvement comprising said barrel assembly including a generally cylindrical barrel having a smooth bore and a rearwardly facing annular shoulder at its rear end, said barrel assembly having means for supporting said barrel for axial reciprocal movement and rotational movement about its axis relative to said receiver and including a barrel sleeve mounted in fixed position on said receiver and defining said chamber, said barrel sleeve having a diametrically enlarged bore forward of said chamber and in coaxial alignment with said chamber for receiving said barrel therein, said barrel sleeve having a forwardly facing annular abutment surface surrounding said chamber at the junction of said chamber and said sleeve bore, means for moving said barrel in an axially forward direction within said barrel sleeve in response to gases of explosion produced by the discharge of around of ammunition within said chamber and including said rearwardly facing annular shoulder and said forwardly facing annular abutment surface, and means for rotating said barrel about its axis in response to forward movement of said barrel within and relative to said barrel sleeve and including a spiral groove formed in said barrel sleeve and opening into said sleeve bore and a lug projecting radially outwardly from said barrel and extending into said groove.

16. In a firearm as set forth in claim 15 the further improvement comprising means for biasing said barrel in a rearward direction and toward said receiver.

17. In a firearm as set forth in claim 16 the further improvement wherein said biasing means comprises a spring coaxially surrounding an associated portion of said barrel and acting between said barrel and said barrel sleeve.

18. In a firearm as set forth in claim 15 the further improvement comprising means for selectively releasably securing said barrel against movement relative to said barrel sleeve.

* * * * *